United States Patent [19]

Urban et al.

[11] 4,018,151

[45] Apr. 19, 1977

[54] APPARATUS FOR VARYING A CYCLIC PATH

[75] Inventors: Joseph J. Urban, Pleasantville, N.Y.; Robert H. Hoenes, Holland, Pa.

[73] Assignee: Crown Cork & Seal Company, Inc., Philadelphia, Pa.

[22] Filed: Dec. 8, 1975

[21] Appl. No.: 638,644

[52] U.S. Cl. ..... 101/40; 74/568 R; 198/478; 198/651

[51] Int. Cl.[2] ..... B41F 17/22

[58] Field of Search ..... 101/40, 39, 38 A, 38 R, 101/247; 198/19, 209, 210, 211, 478, 651; 74/568 R, 568 FS, 568 M, 568 T

[56] References Cited

UNITED STATES PATENTS

| | | | |
|---|---|---|---|
| 3,496,863 | 2/1970 | Cvacho et al. | 101/40 |
| 3,521,554 | 7/1970 | Zurick | 101/40 |
| 3,613,571 | 10/1971 | Russell et al. | 101/40 |
| 3,766,851 | 10/1973 | Sirvet et al. | 101/40 |

*Primary Examiner*—Clifford D. Crowder
*Attorney, Agent, or Firm*—Woodcock Washburn Kurtz & Mackiewicz

[57] ABSTRACT

A rotating container-bearing mechanism includes a follower which travels along an endless groove in a cooperating stationary member. The stationary member includes a radially slidable portion which defines part of the endless groove. The edges of the slidable portion overlap portions of the stationary member and cooperate therewith to form transition zones for smoothly receiving the follower. The slidable portion is actuated by means of an air cylinder and a control responsive to the absence of a container to provide a first path when a container is present and a second path when no container is borne by the follower mechanism.

8 Claims, 5 Drawing Figures

APPARATUS FOR VARYING A CYCLIC PATH

BACKGROUND OF THE INVENTION

The present invention pertains to apparatus for conveying articles about a cyclic path and, more particularly, to apparatus for selectively varying the locus of the path.

In the manufacture of cylindrical containers of the type which have labels or other identifying indicia printed directly upon the outer surface thereof, it is necessary at some point in the manufacturing process to bring the articles into contact with a printing surface. In the manufacture of metal cans, for instance, cans are commonly placed upon a rotatable mandrel and transported along a path which passes by a printing surface. Often the printing surface comprises a rotating roller having a rubber blanket thereon, the blanket being patterned and serving to transfer a coating to the surface of a container brought in contact therewith. By allowing the mandrel to rotate freely, the surface of the container may be brought into direct frictional engagement with the printer blanket to rotate therewith and insure accurate registration of the blanket without smudging. The mandrel carrying the can subsequently travels out of registry with the printing element and eventually discharges the can onto a further conveying section for subsequent handling and processing.

It will be appreciated that the tolerances involved in the foregoing operation are extremely critical. If the path of the mandrel is too close to the printing surface excessive pressure will be brought to bear against the can, possibly distorting the printing blanket and producing a poor print upon the can. On the other hand, if the mandrel does not pass close enough to the printing element the blanket will not engage the can surface sufficiently and a "light" printing will occur in which insufficient coating material is transferred to the can to provide the desired design.

A more serious problem occurs, however, in the event of damage to a can during a preceding manufacturing process. As the cans are conveyed serially to the printing area, each is in turn engaged by a mandrel. If a can is damaged such as by indentation, crushing or tearing it will not fit satisfactorily upon the mandrel and will be discharged or rejected. Since the apparatus carrying the mandrels operates continuously, by the time a damaged can is identified and discharged it is too late to place a subsequent can upon a mandrel and the mandrel proceeds empty about its intended path. Should the empty mandrel continue about its usual path, it will engage the printing blanket. Although it bears no can, the loss in effective diameter is so slight that the mandrel will not completely clear the printing blanket and will receive a certain amount of coating material. Then, as the mandrel cycles about and receives another can the coating material deposited upon the mandrel by the printer will be transferred to the interior of the can.

Varied approaches have been attempted in order to avoid the above-described problem. With one approach the path of the mandrels is defined by a cam. The portion of the cam surface engaged when a mandrel encounters the printing blanket is separably and pivotably mounted. In the absence of a can on a given mandrel the pivotal cam section is swung to an alternate position to cause the mandrel to retract out of engagement with the printing roll. Still another approach is to provide means for sensing the absence of a can upon a given mandrel, and causing the entire printing apparatus to retract as the designated mandrel approaches. Although this approach has gained considerable popularity, the difficulties involved in causing a large, heavy printing element to rapidly advance and retract so as to skip only a predetermined one of a series of rapidly passing mandrels is apparent.

Still another prior art approach utilizes mandrels mounted upon movable arms, which are located by means of individual pneumatic cylinders. Individual cans are held in place on each mandrel by means of a vacuum system wherein a low pressure air channel is coupled to the outer surface of the mandrel for drawing a newly engaged can thereupon, and securing it in position. In the absence of a can the low pressure line continues to draw air through the mandrel, thus signifying that no can has been disposed thereon. Pressure-responsive means then operates valves coupled to the pneumatic cylinder which locates the empty mandrel, causing the mandrel to retract sufficiently to avoid engagement with the printing surface. This approach, however, requires a large number of air cylinders and associated conduits and is inordinately complex.

Accordingly, it will be understood that it would be desirable to provide an improved system for selectively conveying articles along one of two predetermined paths.

It is therefore an object of the present invention to provide improved conveying apparatus in which the path of a selected conveyed article may be rapidly varied.

It is another object of the invention to provide apparatus for selectively varying the path to be described by a moving member, including a cam assembly having a variable surface.

Still another object is to provide a shiftable cam assembly for varying the path of transported containers.

Another object is to provide means for selectively locating containers adjacent a printing surface while maintaining a substantially constant pressure therebetween.

SUMMARY OF THE INVENTION

Briefly stated, in accordance with one aspect of the invention the foregoing objects are achieved by providing a carrier for conveying a container, the carrier being associated with a follower for engaging a cam assembly. The cam assembly comprises a movable and a stationary portion which define a groove for receiving the follower. The movable and stationary portions are provided with overlapping segments which cooperate to define a full-height groove wall in the region where they overlap. The overlapping portions are configured to constitute a transition zone for smoothly receiving the follower when the movable portion is in either of two positions.

In a preferred embodiment driver means are provided for translating the movable cam assembly portion between two positions, and detection and control means are furnished for detecting the absence of a container on the movable member and actuating the driver system.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
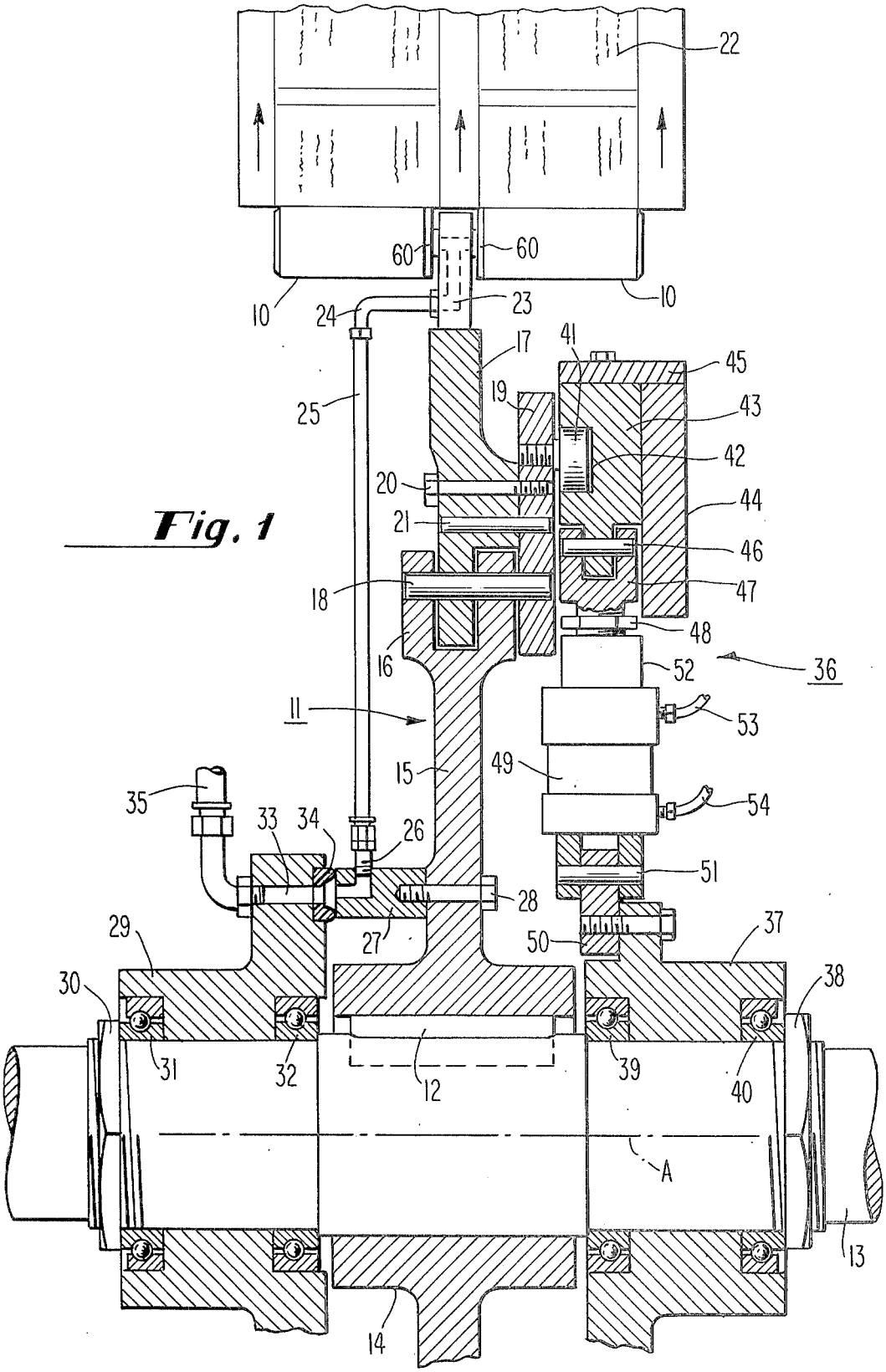
FIG. 1 is a partially sectioned view of an apparatus embodying the present invention.

In FIG. 1 there is shown apparatus for conveying and printing labels or other indicia upon cylindrical containers such as metal cans 10. The cans are conveyed upon a rotor generally indicated at 11, which is secured by means of key 12 to shaft 13 which rotates about an axis A. Means (not shown) such as a gear train or a chain and sprocket drive transfer torque to the shaft from appropriate driving means such as an electric motor. The rotor comprises a hub 14 which surrounds shaft 13 and is slotted to receive key 12, and a web 15 which extends radially outwardly from the hub and terminates in a clevis 16. An outer arm 17 is coupled to clevis 16 by means of a hinge pin 18, and is fixedly secured to a follower support 19 by means of bolt 20 and dowel 21. The follower support is also engaged by hinge pin 18 so that the arm 17 and the follower support 19 pivot about a common axis.

The upper extremity of arm 17 carries a pair of mandrels 60 which slidingly receive cans 10 thereon. The mandrels are rotatably mounted upon the outer end of arm 17 so that cans 10 may turn freely when engaged by printing surface 22. As is well known, the printing surface may comprise a rubber blanket which is provided with inked portions forming a pattern to be imprinted upon the surface of cans 10. Other means, not shown, maintain a coating of ink, varnish or other appropriate material upon the surface of the printing blanket for transfer to the cans. Although in the embodiment shown it is supposed that printing surface 22 will take the form of a cylinder, rotating as shown to contact the cans, it will be apparent to those skilled in the art that other printing mechanisms may be used such as stationary planar surfaces along which cans 10 may roll.

Passages 23 are provided within arm 17 and extend through the mandrels, terminating at the mandrel surface so as to communicate with the interior of cans 10. A fitting 24 engages passages 23, coupling them to a tube 25. The opposite end of tube 25 is coupled by means of fitting 26 to a valve block 27 which is fastened to the web of the rotor by means of cap screw 28 so as to rotate along with the rotor.

Disposed at one side of rotor 11 is a manifold ring 29. The manifold ring is retained upon shaft 13 by appropriate means, such as threaded ring 30 and is fitted with bearings 31, 32 so that the manifold ring can remain stationary while the shaft rotates therewithin. A passage 33 is formed within manifold ring 29, extending from the leftward surface thereof through to a ring seal 34. The ring seal is advantageously made of a low-friction, wear-resistant material such as nylon or Teflon and has apertures formed therein which register with passages 33 of the manifold ring.

Tubing 35 is coupled to the passages in the manifold ring by means of an appropriate fitting so that low-pressure air may be applied thereto. As shown in the figure, when passages 33 align with openings in valve block 27 low-pressure air (i.e., a vacuum) is drawn through tube 25 and passages 23 so as to draw cans 10 tightly over the mandrels therewithin. The negative-pressure system thus provided not only aids in retaining the cans upon the mandrels during operation of the illustrated apparatus, but aids in drawing newly-engaged cans over the mandrels as they are loaded upon the apparatus.

While not visible in the illustration, it will be understood that other passages are provided within manifold ring 29, which sequentially register with the openings in valve block 27 as the rotor turns with respect to the manifold ring. In particular, another tube and coupling arrangement (not shown) is provided and coupled to a source of positive air pressure to urge compressed air through tube 25 and passages 23 so as to force cans 10 off the supporting mandrels after the printing operation is complete. Appropriate means are then provided for receiving the cans which will not mar the newly-printed surfaces, and which convey the cans to subsequent work stations. Such apparatus, however, form no part of the present invention and accordingly are not shown in the figures.

A stator, generally indicated at 36, is disposed adjacent the right side of rotor 11. The stator is mounted upon a stator hub 37 which is in turn encaptured upon shaft 13 by means of threaded ring 38. Bearings 39, 40 are disposed within the stator hub to allow shaft 13 to rotate freely therewithin. In this manner, stator 36 remains motionless in the position illustrated while rotor 11 turns.

It will be understood that the bulk of stator 36 comprises a monolithic element including a web similar to web 15 of the rotor. A track or groove is machined in the face of the web which confronts rotor 11 and receives the cam followers which travel about the groove as rotor 11 turns. At a portion of the stator which is approximately in line with printing surface 22 a movable mechanism is disposed. A roller-like follower 41 is attached to follower support 19 and extends within groove 42. The section of groove shown is formed by an element 43 which defines a movable portion of the groove. The movable portion bears upon a support plate 44 which may be integral with the web of the stator. A stop plate 45 is affixed to the outer periphery of stator 36 and defines the outermost limit of travel of movable portion 43, as will be described hereinafter.

The movable portion is coupled by means of a pin 46 to a clevis 47. In the illustrated embodiment clevis 47 is provided with a threaded shank having disposed thereon an abutment such as stop nut 48. A pneumatic cylinder 49 is coupled to stator hub 37 by means of a bracket 50 and pin 51. A movable piston within the pneumatic cylinder is coupled to the shank of clevis 47 and a rigid outer sleeve 52 adjacent one end of the cylinder forms a stationary abutment which stop nut 48 contacts to limit the downward stroke of the assembly.

Appropriate valving coupled to first air line 53 allows pneumatic pressure to be applied against the upper surface of the piston to force the piston downwardly and cause movable portion 43 of stator 36 to move downwardly (radially inwardly) until stop nut 48 encounters abutment 52. By operating the valving in a complementary manner, air pressure may be applied via second air line 54 to drive the piston of the pneumatic cylinder upwardly, and thus cause the movable portion 43 to rise (move radially outwardly) until it encounters stop plate 45. As will be described hereinafter, the track or groove formed in the stationary and movable portions of the stator 36 cooperate to define two different paths over which follower 41 may travel. With movable portion 43 in its upwardmost position, arm 17 is pivoted radially outwardly so that cans 10 engage printing surface 22. With pressure applied to first air line 53, however, the pneumatic cylinder 49 draws the movable portion 43 downwardly causing follower 41 to follow a path lying radially inwardly of its normal travel. This causes arm 17 to be pivoted slightly inwardly so that cans 10, or the mandrels therewithin, do not engage the printing surface but pass beneath it without contact.

Figure 2:
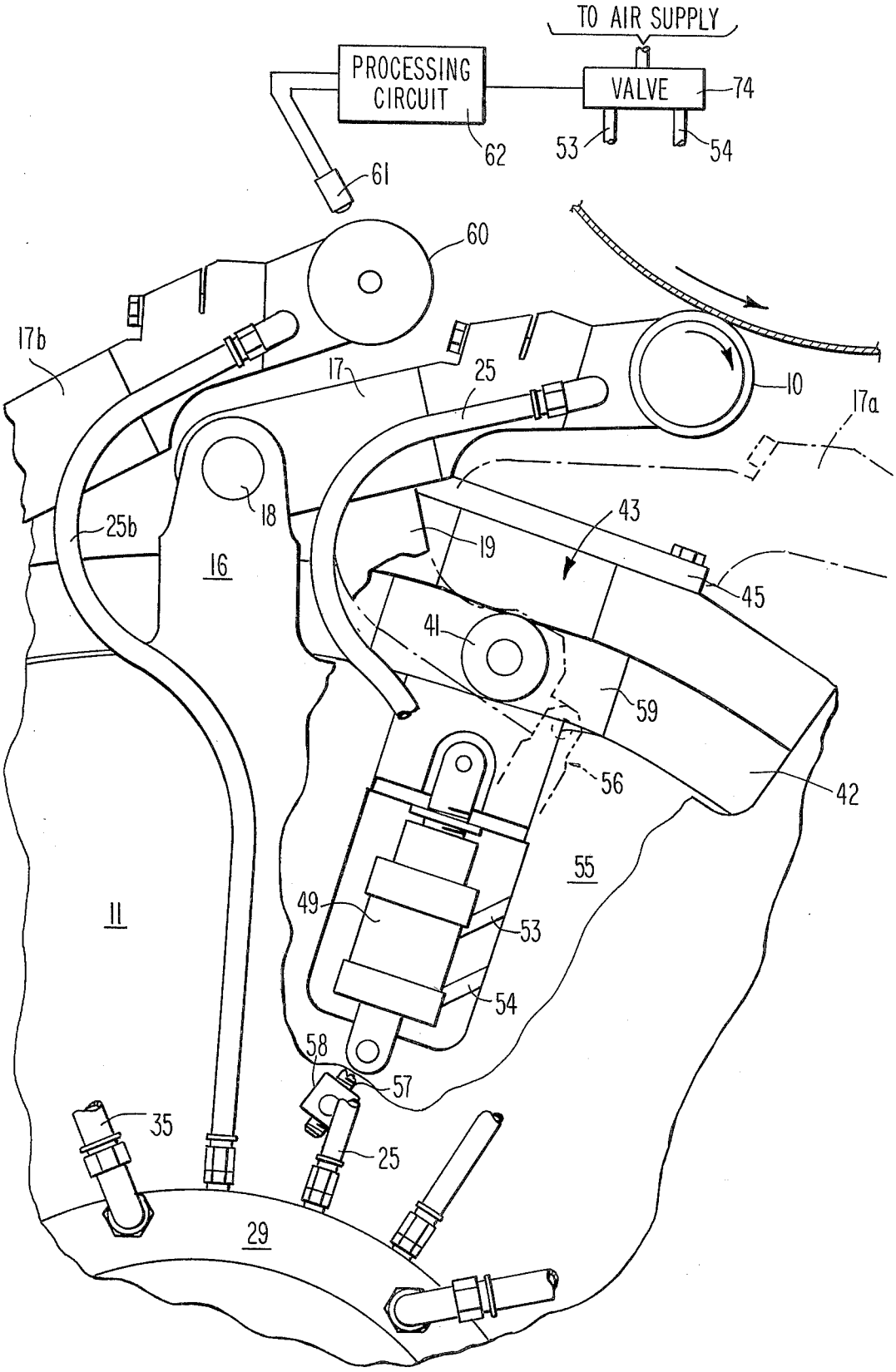
FIG. 2 is a partially sectioned side view of the apparatus of FIG. 1.

Turning now to FIG. 2, there is shown in partly sectioned form a portion of the apparatus of FIG. 1, as seen from the left side thereof. A portion of the web of rotor 11 is broken away so that the construction of the movable portion of stator 36 may be seen. As shown in FIG. 1, an arm 17 is secured to clevis 16 by means of a hinge pin 18. At the outer end of arm 17 is a rotatable mandrel, upon which can 10 is disposed. Can 10 is illustrated as engaging printing surface 22, and rotating thereagainst. Tube 25 serves to supply low pressure air to the interior of the can, receiving the low pressure air from cooperating passages in valve block 27 which is concealed beneath manifold ring 29. Negative (low) air pressure is applied to the manifold ring by way of tubing 35 and thence distributed to the appropriate openings in the valve block.

Web 55 of the stator has an endless track or groove 42 formed therein along a path with which generally follows the outer periphery of the stator. That portion of the groove which lies in the stationary portion of the stator is, of course, fixed and defines an unchanging locus along which follower 41 travels. A changeable part of the groove is formed by movable portion 43.

The arm 17*a* of a preceding mandrel supporting mechanism is shown in phantom form, having been deleted to better illustrate the workings of the inventive embodiment. In order to take up any play in the cam and follower mechanism, biasing means 56 is provided. The biasing means is also shown in phantom form, having been partially deleted in order to better show the workings of the illustrated embodiment. Biasing means 56 may in a preferred embodiment comprise a spring-and-plunger arrangement encased within a tubular envelope and anchored by means of threaded stem 57 in a block 58 affixed to the rotor web; alternatively, a tensioning spring may be utilized. Stop plate 45 is shown attached to the outer periphery of stator 36, being rigidly affixed thereto by appropriate means such as capscrews.

The sides of movable portion 43 are comprised of edge segments 59, which are slidingly received by the stationary portion of the stator in a manner to be described. The edge segments locate the movable portion in the web yet allow it to travel radially inwardly and outwardly between prescribed limits.

Arm 17*b* of a succeeding can support mechanism carries a mandrel 60 and is shown immediately following arm 17. However, no can is present upon the mandrel. An aperture is illustrated at the center of the mandrel for allowing pneumatic pressure to be applied to the interior of a can by means of tube 25*b*. It will now be understood that for all practical purposes each of the plurality of can-supporting members are identical, their attitude and operation being controlled by common means.

Arranged adjacent the path of the mandrels is a proximity detector transducer 61. Although for purposes of illustration the proximity detector is shown adjacent the mandrel just preceding the one at the printing station, it will be understood that the specific location of the detector may be varied to suit a particular application. In a preferred embodiment, mandrels 60 are formed of non-ferrous material such as aluminum, plastic, or other appropriate material. When a can is present upon the mandrel, the electrical characteristics of the juxtaposed mandrel and can are, of course, markedly different than if the can were not present. It is then well within the skill of those familiar with the art to detect the presence of the metallic can through appropriate magnetic, electric or other sensing devices. In one successfully tested embodiment the detection and signal processing system constituted a proximity detector system. It will be recognized, however, that other similar devices may readily be substituted for that shown.

In the present embodiment, signals from the proximity detector transducer 61 are applied to processing circuitry 62. Such processing circuitry advantageously comprises a detection stage responsive to transducer signals indicating the absence of a can upon mandrel 60, a delay stage for purposes to be discussed hereinafter, and an amplifier for outputting signals of sufficient power to operate electromechanical controls. In the present embodiment, the signals outputted by processing circuit 62 are used to operate pneumatic valve 74 which selectively applies pressure to one side or the other of a piston within pneumatic cylinder 49 by way of first or second air lines 53, 54.

It will be apparent that the absence of a can upon mandrel 60 must be detected long enough before the mandrel encounters printing surface 22 to allow pneumatic cylinder 49 to cause the empty mandrel to follow a path spaced inwardly from the surface of the printing element. Accordingly, a time delay is provided in the processing circuitry of the illustrated detector. In the disclosed embodiment, the delay need only be long enough to allow follower 41 to clear the edge of movable portion 43. The movable portion is then translated inwardly, causing the follower of the succeeding mandrel support arm to follow an inwardly displaced path so that mandrel 60 will not engage printing surface 22. Such a delay is thus easily calculated and may be provided by appropriate shift registers or flip-flops, if digital processing circuitry is used, or by means of the familiar resistor-capacitor network if analog-type signals are to be processed.

With movable portion 43 in its extended (outermost) position it will be understood that the principal force causing cans 10 to engage the printing surface is pneumatic pressure. The pressure is transmitted through the piston of pneumatic cylinder 49 to the radially inner wall of groove 42, and thence to the cam follower. By manipulating the pressure of the air in cylinder 49, the force with which cans 10 are impressed against the printing surface can be controlled.

The foregoing characteristic constitutes an advantage in the construction of the system which is ordinarily not found in cam-and-follower systems. In particular, with most fixed cam or groove arrangements there is no significant resiliency in the cam-and-follower system. Accordingly, small differentials in the positioning of the extended end of arm 17 will give rise to severe changes in the pressure arising between the can and printing surface. This is true even in view of the somewhat resilient nature of the printing surface. In order to achieve a consistent degree of pressure with fixed cam-and-follower systems, it is commonly necessary to carefully fit and adjust each individual mandrel-carrying element so that it engages the printing surface to precisely the same degree.

With the present illustrated embodiment, however, a substantial tolerance is afforded due to the compressibility of the air in the pneumatic cylinder. Further, the engagement pressure may readily be controlled by varying the air pressure supplied to the cylinder. Accordingly, by simply controlling the amount of pressure applied to pneumatic cylinder 49 a user of the present invention can achieve substantially constant can-to-printer pressures despite variations in the location of the mandrels.

Figure 3:
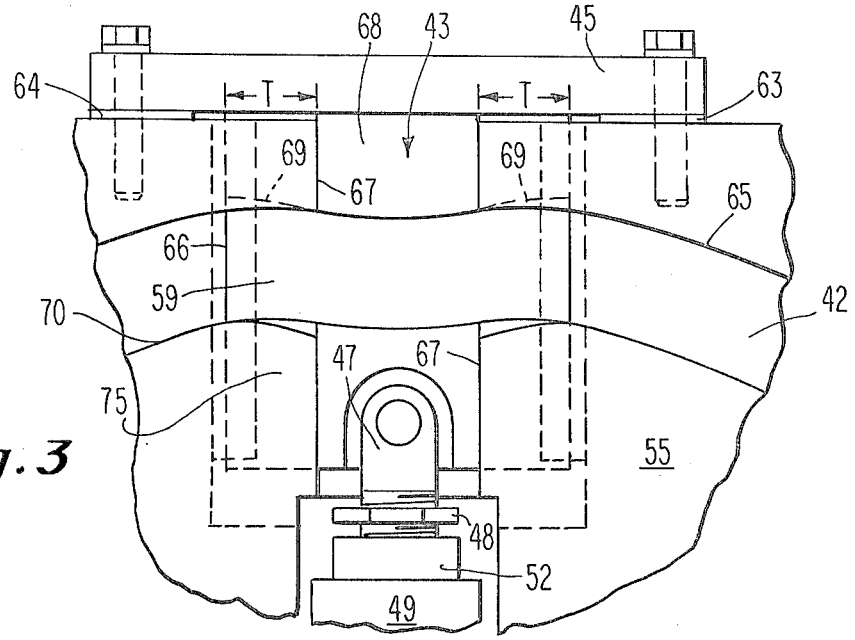
FIG. 3 is an enlarged view showing details of the apparatus of FIG. 2 in a first position.

FIG. 3 shows in more detailed form the construction and cooperation of the stationary and movable portions of stator 36. Cam or groove 42 is shown traversing both the stationary portion and the movable portion 43 of stator 36. In the position illustrated, the pneumatic cylinder 49 has been energized to apply outward pressure to the movable portion, driving it to an outward position wherein it abuts solidly against stop plate 45. In order to precisely adjust the groove defined by movable portion 43, shims 63, 64 are fitted between the stop plate and the adjacent edge of the stator. By using shims of the proper thickness, when the movable portion is forced to its outward position, as shown in the figure, the movable and stationary portions of the cam groove can be closely aligned.

More specifically, it will be understood that cam groove 42 is constituted by a bottom surface and a pair of opposed, substantially parallel walls. A first outer wall surface 65 defines the radially outward side of the cam groove, while the inner side is defined by second wall surface 70. Transition zones T are bounded by the outwardmost edges 66 of movable portion 43, and the opposed, inwardmost edges 67 of the stationary portion of the stator. The edge segments of the adjacent movable and stationary portions, which may be defined as those areas of the stator which lie within the transition zones, thus overlap one another as shown. In the illustrated embodiment, the stationary portion of the stator is undercut to form elongate T-shaped slots or T-slots which receive the edge segments 59 of movable portion 43. Overlying the edge segments are the corresponding edge segments 75 of the stationary portion, which terminate at inner edge 67. Since the aforementioned segments overlie one another, the height of the wall which is defined by any given segment is necessarily less than the total wall height (groove depth). In constradistinction, the central segment 68 of movable portion 43 is of a height substantially the same as the surrounding, stationary portions of the stator, and thus forms cam groove walls of full height.

The effect of the foregoing construction is that the wall segments lying in the transition zone and which are disposed closest to the center of the groove define the path to be followed by a cam follower. In FIG. 3, for instance, it will be seen that the movable portion 43 is disposed in its radially outward position. Due to the configuration of the edge segments of the movable portion, in the transition zones T the radially outer wall surfaces are retracted beneath the stationary portion, as indicated by dotted lines 69. The outer wall surface in the central segment 68 of the movable portion 43 is configured to smoothly align with the walls formed by the edge segments of the stationary portion. In this manner a smooth, continuous outer wall is defined by the central segment 68 of the movable portion and the edge segments of the stationary portion 75.

The inner or second wall of groove 42 is defined in transition zones T by the partial-height walls of the edge segments of movable portion 43. Since in the transition zone the inner wall surfaces of the movable portion protrude from beneath the stationary wall sections, the cam follower will ride along the movable, rather than stationary, inner wall sections. The inner wall sections in the transition zones T are configured to blend smoothly into the full-height stationary wall of the cam groove which lies outside the transition zones.

Figure 4:
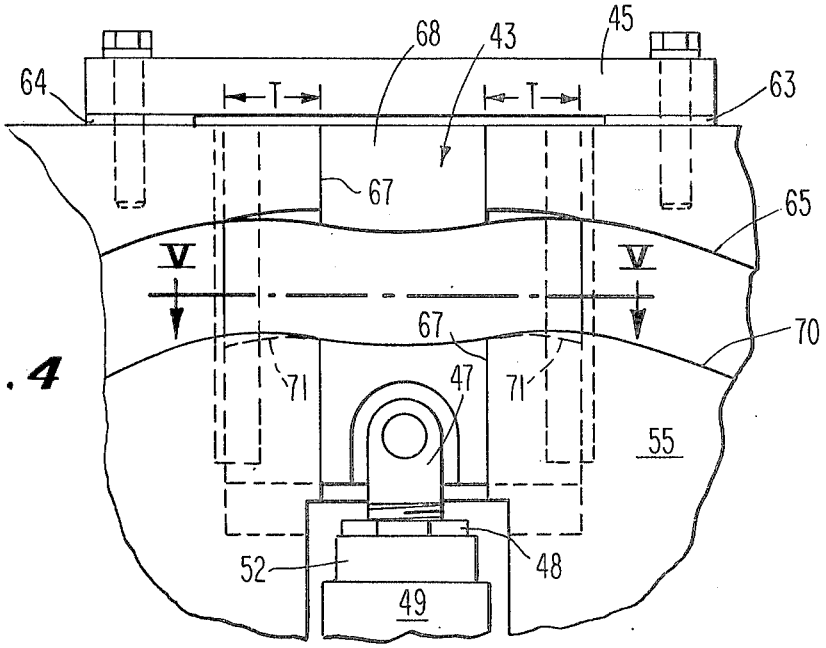
FIG. 4 is a view similar to FIG. 3 showing the apparatus in a second position.

FIG. 4 shows the assembly depicted in FIG. 3, but with the movable portion 43 in a retracted position. In this position the can-carrying mandrels are retracted from the printer surface, and accordingly the cam followers thereof follow a locus displaced radially inwardly from the normal path of travel. In the position depicted in FIG. 4, it is anticipated that the detection system illustrated in FIG. 2 has operated the appropriate valving to cause pneumatic cylinder 49 to retract until stop nut 48 engages abutment 52. By running the stop nut up or down the threaded shank of clevis 47, the retracted position of movable portion 43 may be precisely adjusted.

In the position illustrated, the outer cam groove wall 65 which lies beyond the overlapping or transition zones T continues to be defined by the full-height walls, which are unchanged from their previous disposition. However, the outer wall surface in transition zones T is now defined by partial-height outer wall surfaces of movable portion 43. The contour of these partial-height walls is carefully generated so as to blend smoothly into the adjacent full-height walls of the stationary portion. The full-height walls of central segment 68 of the movable portion are unchanged in configuration from FIG. 3. However, these walls are now displaced radially inwardly a distance determined by stop nut 48.

The configuration and location of the inner wall 70 of the cam groove has changed, in concert with the configuration of outer wall 65. In particular, while the full-height inner wall within the central segment 68 of the movable portion remains the same in contour, it has been displaced radially inwardly by the distance which movable portion 43 has retracted. The partial-height inner walls formed in the edge segments 59, and which previously defined the path of follower travel, are now retracted beneath the partial-height walls of the overlying stationary portion, as shown by dotted lines 71. Accordingly, the inner walls in the transition zones T are defined by the edge segments of the stationary portion of the stator.

From an inspection of the figures, it will now be apparent that a smooth, continuous wall configuration is present for both the projected and retracted positions of the movable stator portion. This desideratum is accomplished by the complementary configuration of the partial-height wall surfaces of the edge segments lying in the transition zones T. In particular, it will be seen that when the movable portion 43 is retracted, the inner wall surfaces 70 of the transition zones T are defined by the stationary edge segments while the outer wall surfaces 65 are defined in these zones by the movable edge segments. With movable portion 43 extended, the inner wall surfaces of the transition zones are defined by the movable edge segments, while the outer wall surfaces in these zones are defined by the stationary edge segments.

In order to accomplish this, the width of the grooves in the edge segments of both the movable and stationary portions are caused to increase as the edge of the respective portion is approached. In particular, for the stationary portion it will now be appreciated that the distance between the partial-height walls of the stationary edge segments progressively increases in transition zones T until, at the edges of the portion which abut central section 68 the distance between the walls has increased by an increment substantially equal to the displacement afforded movable portion 43. Similarly, while the width of groove 42 in the central section 68 is substantially constant in the edge segments 59 it progressively increases until at the outermost edges 66 of the movable portion the distance between the walls has increased by an increment corresponding to the displacement of the movable portion. Due to the complementary manner in which the walls of the stationary and movable portions diverge in the transition zones, a constant-width groove is defined by the overlapping edge segments when the movable portion is at either extreme of its travel.

Figure 5:
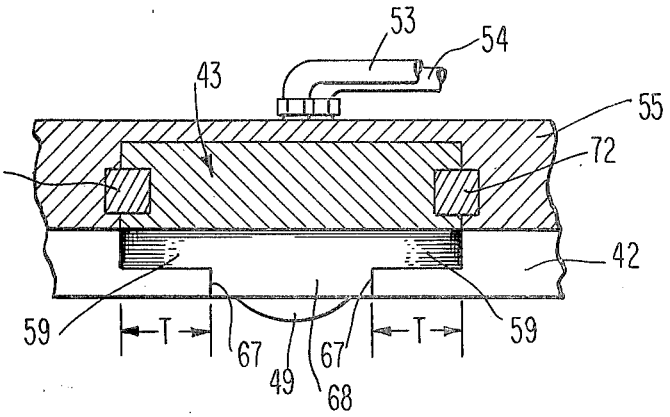
FIG. 5 is a view taken along the line V—V of FIG. 4.

Turning now to FIG. 5, a sectional view of the area about movable portion 43 is shown. The upper surface of pneumatic cylinder 49 is visible projecting above the stator surface, with first and second air lines 53, 54 extending therebeneath. A cavity which may be generally described as a T-slot has been formed within the stationary portion of the stator in order to slidingly receive the edge segments of movable portion 43. A pair of gibs 72, 73 act as ways for precisely locating the movable portion, and may constitute hardened bearing surfaces upon which the movable portion slides.

It can now be seen that the wall of groove 42 remains at a substantially constant height. In transition zones T the total wall height is comprised of the overlapping edge segments of the stationary and movable portion. In the embodiment illustrated, movable section 43 has assumed a retracted position so that the edge segments 59 are retracted beneath the overlying edge segments of the stationary portion 55. In this manner the stationary edge segments define the inner wall of the transition zones against which the cam follower will ride.

As will be evident from the foregoing description, certain aspects of the invention are not limited to the particular details of the examples illustrated and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. Apparatus for transporting a series of cylindrical containers past a printer station to allow a coating to be deposited upon the containers, comprising:

a carrier for conveying containers including a plurality of mandrels for engaging ones of the containers, a plurality of support means movably locating said mandrels on said carrier, and a plurality of followers each carried by ones of said support means;

a cam assembly defining an endless groove of substantially constant width for engaging said followers to cause said mandrels to follow a predetermined path, said groove comprising inner and outer side walls and being interrupted by a generally transverse slot having a T-shaped cross-section to form a T-slot, the opposed side walls of reduced height intercepted by the lateral segments of the T-slot diverging by a distance *d* to broaden the groove and form a pair of transition zones;

a movable portion having a T-shaped cross-section and slidably received in said T-shaped slot, the center segment of said T-shaped portion defining upstanding side walls of a height generally the same as the height of said groove, the edge segments at either side of the movable portion defining side walls of a height substantially less than the depth of said groove and overlying the opposed side walls of reduced height, the side walls defined by the edge segments of said movable portion diverging by said distance *d;* and means coupled to said movable portion for controllably displacing said movable portion by said distance *d.*

2. Apparatus for transporting a series of metal cans and effecting the selective registration of ones of said cans with an adjacent printer, comprising:

a rotatable carrier for carrying the cans along a arcuate path adjacent the printer and including a plurality of rotatable mandrels for receiving ones of the cans, a plurality of pivoted support means each carrying at least one mandrel, and a follower coupled to each of said support means at a fixed distance from the pivot point thereof;

a fixed cam assembly disposed adjacent said carrier and comprising a stationary and a movable portion which cooperate to define the bottom and the inner and outer sidewalls of an endless groove, said stationary and movable portions having overlapping edge segments which comprise opposed portions of the walls of said groove at a pair of points along the length of said groove, said stationary portion being provided with a gap for receiving said movable portion, the edges of said gap having elongate slots for receiving opposed edge segments of said movable portion, said movable portion including a center segment 68 and an edge segment 59 lying at either side of the center segment and a groove 42 extending transversely across all of said segments to define inner and outer upstanding sidewalls 70, 65;

said movable portion being translatable between an outer position in which:

the portion of the outer groove wall defined by said center section 68 aligns with the stationary portion walls on either side of said gap to define a continuous outer wall, and the portions of the inner wall defined by said movable edge segments 59 align with the stationary portion walls lying on either side of said elongate slots, and an inner position in which:

the portion of the inner groove wall defined by said center section 68 aligns with the stationary portion walls on either side of said gap to define a continuous inner wall, and the portions of the outer wall defined by the movable edge segments 59 align with the stationary portion walls lying on either side of said elongate slots; and means for displacing said movable portion between said first and said second positions in response to the presence or absence of a can upon the mandrel of a pivoted means whose follower is approaching said movable portion of said cam assembly.

3. Apparatus as defined in claim 2, wherein said means for displacing comprises a pneumatic cylinder, a valve for controlling air pressure supplied to said cylinder and detector means for detecting the absence of a can upon a mandrel and operating said valve means in response thereto.

4. Apparatus as defined in claim 3, wherein said pivoted support means each carries a pair of opposed rotatable mandrels.

5. Apparatus as defined in claim 4, further including means for varying the pressure applied to said pneumatic cylinder to thereby control the pressure exerted against the surface of a printer by a can registering therewith.

6. Apparatus for selectively varying the path described by a moving member, comprising:

a movable support for carrying said member and including a follower;

a cam assembly defining a groove having a bottom and a first and a second wall for receiving said follower and for determining the path of the member, said cam assembly including a first portion defining a first section of said groove, said first portion being interrupted by a gap, the edge segments of the first portion on either side of the gap having a height less than the depth of said groove, said edge segments defining a transition zone of a predetermined width on either side of the gap, the second wall of said first section of said groove progressively departing from the first wall thereof as the distance to the gap diminishes, and a second portion slidably disposed in said gap and defining a second section of said groove, said second portion including a central segment and a pair of opposed edge segments, said edge segments each having a width substantially equal to said predetermined width and a height less than the depth of said groove, the first wall of said second section of said groove progressively departing from the second wall as the distance to the edge diminishes, the amount of departure being substantially equal to the amount of departure of the second wall of said segments of said first section; and means for translating said second portion in said slot.

7. Apparatus as defined in claim 6, wherein the segments of one of said portions overlie the segments of the other of said portions, the combined height of the walls defined by the juxtaposed segments comprising the full depth of said groove, and means for limiting the translation of said second portion to a distance substantially equal to the departure of said walls in said transition zones.

8. Apparatus as defined in claim 7, wherein said first portion comprises a pair of opposed channels extending away from said gap for receiving said edge segments of said second portion, the central segment of said second portion being substantially equal in width to said gap.

* * * * *